US008413445B2

(12) United States Patent
Poyyapakkam

(10) Patent No.: US 8,413,445 B2
(45) Date of Patent: Apr. 9, 2013

(54) METHOD AND SYSTEM FOR POROUS FLAME HOLDER FOR HYDROGEN AND SYNGAS COMBUSTION

(75) Inventor: Madhavan Poyyapakkam, Karnataka (IN)

(73) Assignee: General Electric Company, Schenectady, NY (US)

( * ) Notice: Subject to any disclaimer, the term of this patent is extended or adjusted under 35 U.S.C. 154(b) by 813 days.

(21) Appl. No.: 11/747,528

(22) Filed: May 11, 2007

(65) Prior Publication Data

US 2008/0276618 A1 Nov. 13, 2008

(51) Int. Cl.
*F02C 1/00* (2006.01)

(52) U.S. Cl.
USPC ..... 60/737

(58) Field of Classification Search ..... 60/737, 60/738, 740, 742, 746, 747, 748, 749
See application file for complete search history.

(56) References Cited

U.S. PATENT DOCUMENTS

| | | | | | |
|---|---|---|---|---|---|
| 2,632,299 | A * | 3/1953 | Loughran | 60/746 |
| 4,047,877 | A * | 9/1977 | Flanagan | 431/8 |
| 4,150,954 | A * | 4/1979 | Abthoff et al. | 48/102 A |
| 4,752,213 | A * | 6/1988 | Grochowski et al. | 431/328 |
| 5,017,129 | A * | 5/1991 | Velie et al. | 431/326 |
| 5,038,742 | A * | 8/1991 | Uddin | 123/549 |
| 5,319,923 | A * | 6/1994 | Leonard et al. | 60/39.23 |
| 5,437,159 | A * | 8/1995 | Ansart et al. | 60/746 |
| 5,611,684 | A * | 3/1997 | Spielman | 431/353 |
| 6,077,483 | A * | 6/2000 | Locker et al. | 422/179 |
| 6,199,364 | B1 | 3/2001 | Kendall et al. | |
| 6,330,791 | B1 | 12/2001 | Kendall et al. | |
| 6,339,925 | B1 * | 1/2002 | Hung et al. | 60/777 |
| 6,409,096 | B2 * | 6/2002 | Popp | 239/124 |
| 6,453,672 | B1 | 9/2002 | Kendall et al. | |
| 6,470,687 | B1 | 10/2002 | Kendall et al. | |

(Continued)

FOREIGN PATENT DOCUMENTS

| | | | |
|---|---|---|---|
| GB | 1454893 A * | 11/1976 | 60/776 |
| JP | 52036341 A | 3/1977 | |

(Continued)

OTHER PUBLICATIONS

Chung-jen Tseng, "Effects of Hydrogen Addition on Methane Combustion in a Porous Medium Burner", International Journal of Hydrogen Energy 27 (2002), pp. 699-707.

(Continued)

*Primary Examiner* — Phutthiwat Wongwian
(74) *Attorney, Agent, or Firm* — Nixon & Vanderhye P.C.

(57) ABSTRACT

A fuel nozzle assembly for a combustor in a gas turbine including: a gaseous fuel passage and a fuel nozzle at a distal end of the passage; an air tube concentric with the fuel nozzle and defining an air passage between the air tube and the fuel nozzle, wherein the air tube includes a distal section extending axially beyond the fuel injection nozzle; a first fuel-air mixing zone inside the distal section of the air tube, wherein the first fuel-air mixing zone is downstream of the fuel injection nozzle; a flame holder including a porous structure with thermal barrier coating and micro swirlers and defining a downstream end of the first fuel-air mixing zone, wherein fuel and air from the first fuel-air mixing zone pass through the porous structure of the flame holder and into a combustion zone of the combustor.

8 Claims, 2 Drawing Sheets

U.S. PATENT DOCUMENTS

| | | | | |
|---|---|---|---|---|
| 6,612,295 | B2 * | 9/2003 | Lerner | 123/593 |
| 7,004,408 | B2 * | 2/2006 | Vecchiet et al. | 239/558 |
| 2002/0148226 | A1 | 10/2002 | Kendall et al. | |
| 2005/0268616 | A1 | 12/2005 | Widener | |
| 2006/0021331 | A1 * | 2/2006 | Cizeron et al. | 60/286 |
| 2006/0288706 | A1 | 12/2006 | Ziminsky et al. | |
| 2007/0204624 | A1 * | 9/2007 | Smith et al. | 60/773 |

FOREIGN PATENT DOCUMENTS

| | | | |
|---|---|---|---|
| JP | 63207915 | A | 8/1988 |
| JP | 05203149 | A | 8/1993 |
| JP | 07103427 | A | 4/1995 |
| JP | 09222228 | A | 8/1997 |
| JP | 2004519652 | A | 7/2004 |
| JP | 2006105534 | A | 4/2006 |
| WO | 02075211 | A1 | 9/2002 |

OTHER PUBLICATIONS

JP Office Action dated Jun. 26, 2012 from corresponding Application No. 2008-122914 along with unofficial English translation.

* cited by examiner

METHOD AND SYSTEM FOR POROUS FLAME HOLDER FOR HYDROGEN AND SYNGAS COMBUSTION

BACKGROUND OF THE INVENTION

This invention relates to the mixing region of the fuel nozzle assembly for a combustor in a gas turbine burning on Syngas or hydrogen fuels. Less forgiving properties of hydrogen (H2) and syngas fuels such as higher flame speeds, lower ignition times makes it impossible to use prior art designs applicable only for burning natural gas fuels.

Industrial gas turbines have a combustion section typically formed by an array of can-annular combustors. Each combustor includes a fuel nozzle mixing region that provides specified amounts of fuel-air mixture to a combustion zone within the combustor. The fuel-air mixture is allowed to burn inside the combustion zone to generate hot, pressurized combustion gases that drive a turbine.

Natural gas, e.g., primarily methane, is a common fuel for industrial gas turbines. Rapid depletion of hydrocarbon resources has led to an increased focus on using coal derived $H_2$ and/or syngas for industrial gas turbines. The flame speed of hydrogen and syngas is significantly higher, e.g., six to seven times faster, than the flame speed of natural gas. The burner needs to be designed to operate for greater flame speed of hydrogen and syngas which could increase the propensity for flame flashing back in to the mixing region of the fuel nozzle assembly. Flame holding in the unburnt mixing region has the potential to damage the components of the nozzle assembly. There is a strong need to design and develop devices and methods to prevent propagation of flame into the fuel nozzle assembly.

Syngas refers to a gas mixture available in varying amounts of carbon monoxide and hydrogen generated by the gasification of a carbon containing fuel to a gaseous product. Syngas examples include steam reforming of natural gas or liquid hydrocarbons to produce hydrogen, the gasification of coal and in some types of waste-to-energy gasification facilities. Syngas is combustible and often used as a fuel source. Syngas may be produced, for example, by gasification of coal or municipal waste.

Existing combustor operating on natural gas may need major modifications to accommodate additional burning of hydrogen and syngas fuels. For example, the higher flame speed of hydrogen and syngas (as compared to natural gas) may require combustor adjustments to ensure that the flame is stabilized in the combustion zone and does not propagate upstream into the mixing region of the fuel nozzle assembly. There is a strong need to develop methods and devices to modify the existing natural gas combustor designs to allow burning of hydrogen and syngas fuels.

BRIEF DESCRIPTION OF THE INVENTION

A fuel nozzle arrangement is disclosed for a combustor in a gas turbine, the assembly including: a gaseous fuel nozzle having a center axis and extending along the center axis, the fuel injection nozzle including a gaseous fuel passage and a fuel nozzle at a distal end of the passage; an air tube concentric with the fuel nozzle and defining an air passage between the air tube and the fuel nozzle, wherein the air tube includes a distal section extending axially beyond the fuel injection nozzle; a first fuel-air mixing zone defined by and inside the distal section of the air tube, wherein said first fuel-air mixing zone is downstream of the fuel injection nozzle; a flame holder comprising a porous structure and defining a downstream end of the first fuel-air mixing zone, wherein fuel and air from the first fuel-air mixing zone pass through the porous structure of the flame holder and into a combustion zone of the combustor.

A method is disclosed for combusting a gaseous fuel in a combustor of a gas turbine, the method comprising: injecting a gaseous fuel into an air tube of a fuel injection assembly; mixing air and gaseous fuel in the air tube, wherein in the air passes through the air tube and the gaseous fuel is discharged from a nozzle into the air tube; passing the mixture of air and gaseous fuel through a porous medium at a distal end of the air tube, and combusting the mixture of air and gaseous fuel downstream of the porous medium in a combustion zone of the combustor.

A method is disclosed for modifying the mixing region of a natural gas nozzle assembly to a syngas or hydrogen nozzle assembly, the method includes: placing a porous flame stabilizer a distal end of an air tube of the nozzle assembly, and allowing fuel and air from the nozzle assembly through the flame stabilizer before the mixture is burnt in a combustion zone. The method may further include selecting the porous flame stabilizer in such a way that it creates the necessary pressure drop between a combustion zone immediately downstream of the flame stabilizer and an air fuel mixture in the air tube and immediately upstream of the flame stabilizer, wherein the required pressure drop is sufficient to prevent propagation of flame through the flame stabilizer. Higher pressure drops in the porous structure results in increased fuel-air mixture velocities for stabilizing the high flame speeds of H2/syngas fuels.

DETAILED DESCRIPTION OF THE INVENTION

A porous flame stabilizer has been developed for insertion into a mixing region of a fuel nozzle assembly of a combustor for an industrial gas turbine. The flame stabilizer has a high porosity to allow sufficient amount of fuel and air mixture to flow through the media at a higher velocity and design pressure drops. The porous structure prevents the propagation of flame upstream in to the structure and the mixing region. The propagation of flame is prevented by allowing higher mixture velocities in the porous structure and the structure can itself act like an arrestor to the flame. The porous structure may include a thermal barrier coating (TBC) on a downstream region of the structure. The TBC shields the porous structure from being exposed to flame residing downstream of the structure.

Figure 1:
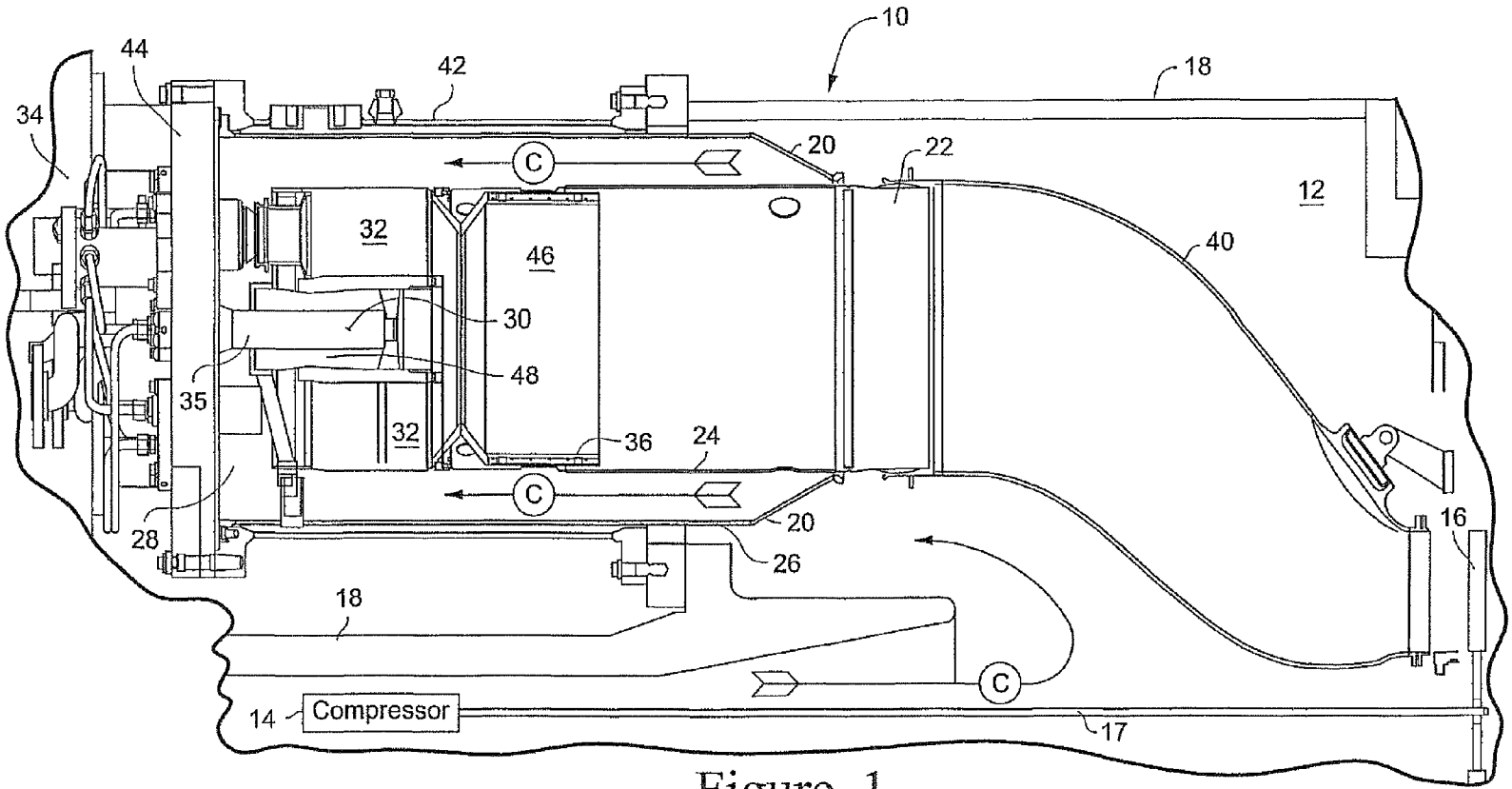
FIG. 1 is a side, cross-sectional view of a combustor in an industrial gas turbine.

FIG. 1 shows a combustor 10, in partial cross-section, for a gas turbine 12 having a compressor 14 (partially shown), a plurality of combustors 10 (one shown), and a turbine represented here by a single turbine blade 16. The turbine is drivingly connected to the compressor along a shaft 17. Compressor air (C) reverse flows to the combustor 10 where it is used to cool the combustor and to provide air to the combustion process.

The gas turbine includes a plurality of combustors 10 arranged in an annular array about the periphery of the gas turbine casing 18. High pressure air from the compressor 14 flows (see flow arrow C) to the combustor through a compressed air inlet 20 near the hot gas outlet 22 of the combustor. The compressed air flows (C—in a counter-direction to the combustion gases within the combustor) through an annular passage defined by the combustor flow sleeve 24 and the combustor liner 26 to a combustor inlet 28.

Each combustor 10 includes a substantially cylindrical combustion casing 42 which is secured to the gas turbine casing 18. The inlet end 28 of the combustion casing is closed by an end cover assembly 44 which may include conventional fuel and air supply tubes, manifolds and associated valves for feeding gas, liquid fuel and air (and water if desired) to the combustor as described in greater detail below. The end cover assembly 44 receives a plurality (for example, five) outer fuel nozzle assemblies 30, 32 arranged in an annular array about a longitudinal axis of the combustor. The array of outer fuel nozzle assemblies 32 is arranged around a center fuel nozzle assembly 30 that may be small (in terms of size and fuel flow) relative to the outer nozzle assemblies 32.

Fuel, e.g., syngas, hydrogen, natural gas or a mixture of two or more of these gases, is supplied to the inlet of each fuel nozzle assemblies 30, 32 by fuel piping and manifolds 34 connected to the end cover assembly 44. Gaseous fuel enters an inlet to a fuel nozzle assembly 35 having a gas passage cylinder extending along an axis of the nozzle assembly 30, 32. Gaseous fuel is discharged from a distal end of the fuel nozzle assembly 35 and into an air tube gas passage(s) 48. The air tube is concentric with the nozzle assembly, which is housed in the air tube. Compressor air (C) enters the inlet 28, flows through the air tube and mixes with gaseous fuel discharged from the nozzle assembly 35. The mixture of fuel and air flows into a combustion zone 46 downstream of the nozzle assemblies 30, 32.

Each fuel nozzle assembly 30, 32 provide controlled amounts of fuel-air mixture to the combustion zone. The air and fuel are initially mixed in a distal end of the air tube 48 and the mixture flows into the combustion zone 46 generally defined by an air-cooled flame tube 36. Ignition of the fuel-air mixture is achieved in the combustion zone by spark plug(s) in conjunction with cross fire tubes (not shown) between combustors 10. At the downstream end of the combustion zone 46, hot combustion gases flow through a double-walled transition duct 40 that connects the outlet end 22 of each combustor with the inlet end of the turbine (see blade 16) to deliver the hot combustion gases to the turbine.

Figure 2:
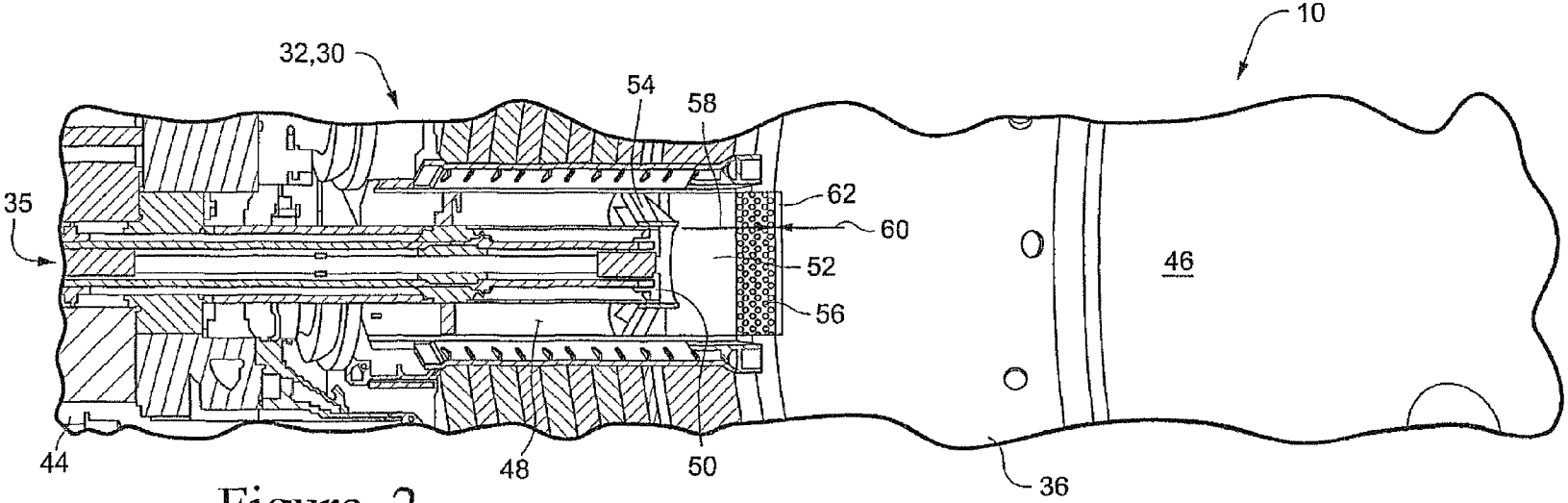
FIG. 2 is side, cross-section of the mixing region of a fuel-air nozzle assembly and a partial cross-section of a combustor.

FIG. 2 is a side, cross-sectional view of a fuel nozzle assembly 30, 32 in a combustor 10. The fuel nozzle assembly includes a gaseous fuel nozzle assembly 35 extending along an axis of the assembly 30, 32. The nozzle extends through an air tube 48. Fuel and air manifolds at the end cover assembly 44 provide gaseous fuel and air in a controlled ratio or amount to the nozzle and air tube, respectively. The fuel nozzle 35 and air tube 48 may be conventional components of a fuel nozzle for a combustor of a natural gas turbine. For example, U.S. Published Patent Applications 2003-0121269 A1 and 2006-0288706 A1 show exemplary fuel nozzle assemblies for an industrial gas turbine capable of operating on a natural gas fuel.

The air tube 48 may be a cylindrical gas passage formed of a thin metal tube. The air tube is concentric with the fuel nozzle 35 which is contained within the tube. The fuel discharge nozzle 50 at the end of the fuel nozzle 35 is within the air tube 48. The distal portion 52 of the air tube extends beyond the fuel discharge nozzle 50. Gaseous fuel discharges from the nozzle 50 into the distal portion 52 of the air tube. Compressor air flowing through the air tube begins to mix with the gaseous in the distal portion of the air tube.

Swirl vanes 54, e.g., a thin metal disc with radial vanes, may be in the air tube upstream of the nozzle 50. The swirl vanes impart a rotation to the air flow that promotes mixing with fuel and the expansion of the mixture into the larger volume of the combustion zone 46. Swirl vanes are conventional components often included in the air tube of natural gas air fuel nozzles 30, 32. The swirl vanes may be retained when the air fuel nozzles are modified to operate on hydrogen gas or syngas. Alternatively, the swirl vanes may be removed when the nozzles are modified to operate on hydrogen gas or syngas. If the swirl vanes are removed, a new swirl component is preferably added to the nozzles 30, 32 to swirl the fuel-air mixture and to promote mixing of the fuel and air to enhance combustion and flame stabilization. The modified air fuel nozzles may be capable of operating on natural gas, hydrogen, syngas or a combination of these gases. The fuel-air mixture discharging from the porous structure with micro swirlers results in formation of multiple micro flames producing lower NOx, CO and higher flame stability.

A high porosity flame stabilizer 56 may be positioned at the outlet of the air tube 48. The flame stabilizer helps in increasing fuel-air velocities through the air tube and into the combustion zone 46. In addition, the flame stabilizer may impart a swirl to the fuel-air mixture. Microswirlers, e.g., small vanes or cork-screw shaped flow passages, may be embedded in the stabilizer. The flame stabilizer arrests flame and prevents the propagation of flame upstream of the stabilizer into the air tube. The flame stabilizer also behaves like a passive control device for mitigating high frequency thermo acoustic oscillations.

The flame speed of hydrogen and syngas may be significantly faster, e.g., six to seven times as fast, as the flame speed of natural gas, e.g., methane. The flame speed may exceed the flow velocity of the air fuel mixture passing through the air tube. But for case with no flame stabilizer, the syngas or hydrogen flame may propagate upstream into the air tube and fuel discharge nozzle. To avoid such propagation of the flame, the flame stabilizer increases the fuel-air mixture velocities and arrests the propagation of the flame at the downstream face of the flame stabilizer.

The high porosity of the flame stabilizer 56 allows the air and fuel mixture to flow through the porous media of the stabilizer at a sufficient rate to provide effective combustion and generate sufficient volumes of hot combustion gases in the combustion zone 46 to drive the turbine 16. Sufficiently high pressure drop across the flame stabilizer (represented by the right pointing arrow 58) is sufficient to prevent a fast moving flame (represented by the left pointing arrow 60) from entering and/or passing through the porous media of the stabilizer. An optimum pressure drop is chosen depending on the flame speed of the gaseous fuel and the flow rate of the air fuel mixture through the air tube. The porosity and thickness of the flame stabilizer is selected to achieve the desired pressure drop. Assuming that the pressure drop is properly selected, the upstream extend of combustion should be adjacent to the downstream face of the porous media of the flame stabilizer 56. Accordingly, the porous flame stabilizer preferably anchors the flame slightly off the downstream face of the porous media of the flame stabilizer 56.

The downstream face of the flame stabilizer may be coated with the thermal barrier coating (TBC) 62, e.g., a high temperature ceramic. The TBC shields the stabilizer from the heat, e.g., radiant and conductive, of the combustion flame. The TBC is preferably applied to the surfaces of the stabilizer exposed to the flame.

Figure 3:
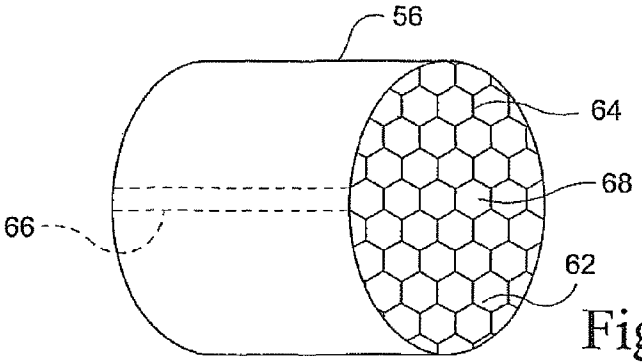
FIG. 3 is a side view of a porous flame stabilizer.

FIG. 3 is a perspective view of an exemplary flame stabilizer 56. A honeycomb structure 64 is one example of a porous flame stabilizer. An array of multiple passages is illustrated by dotted lines showing a single passage 66. The flow passages 66 are formed by the honeycomb structure and may be constricted at the outlet ends 68. The constrictions may, for example, be formed by coating the ends 68 so as to form bulbous or anvil shaped side walls between the passages. The coating applied to constrict the outlet of the passages may be a thermal barrier coating (TBC). The build-up of the TBC may form the flow constrictions in the passages. The constriction of outlet ends of the passages 66 may be used to determine the desired pressure drop across the stabilizer 56. Further the blunt ends of the sidewalls may form eddy flows that enhance air fuel mixing and contribute to flame stabilization at the downstream face of the flame stabilizer.

Further, the passages 66 may spiral or cork-screw through the stabilizer. The spiral or cork-screw passages impart swirl to the fuel-air mixture that can supplement swirl vanes upstream of the stabilizer or replace the swirl vanes. In addition to a honeycomb structure, the flame stabilizer may be formed of structures such as: a matrix of interconnected fibers, a mesh and a sponge. These are exemplary structures. Further, the flame stabilizers may be a disc that fits onto the end of each air tube, a plug that fits into the end of each air tube or some other structure through which flows the fuel-air mixture. It is preferred that the flame stabilizers be added to the combustor with minimal modification needed to the combustor.

The flame stabilizer 56 may provide a relatively low cost and easy to install device for converting a natural gas combustor in a gas turbine to a combustor capable of burning hydrogen or syngas. To convert a natural gas burning gas turbine to hydrogen or syngas, a flame stabilizer may be positioned in the discharge end or adjacent the discharge end of a flame tube in each fuel nozzle 30, 32 of each combustor of the gas turbine. Optionally, the swirl vanes 52 may be removed and replaced by the flame stabilizer. Further, the fuel manifold and fuel supply lines may be modified to accept hydrogen or syngas.

The flame stabilizer 56 promotes stable combustion in the combustion zone 46, even for fuels having fast flame speeds. A potential benefit of enhanced stable combustion is an decrease in the fuel-air ratio to achieve stable combustion. The fuel-air ratio is the proportions of gaseous fuel and air that are mixed in the Increasing the range of fuel-air ratios fuel nozzles 30, 32. Increasing the range of fuel-air ratios that provide stable combustion may allow for fuel-air ratios that result in low nitric-oxide emissions, increased fuel economy, lower combustion temperatures and acceptable thermo acoustic pulsations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An air fuel assembly for a combustor in a gas turbine, the assembly comprising:

a gaseous fuel injection nozzle assembly having a center axis and including a gaseous fuel passage extending along the center axis, and a fuel nozzle at a distal end of the gaseous fuel passage, wherein said gaseous fuel injection nozzle assembly continuously injects gaseous fuel into the gaseous fuel passage;

an air tube concentric with the fuel injection nozzle assembly and defining an air passage between the air tube and the fuel injection nozzle assembly, wherein the air tube includes a distal section extending axially beyond the fuel injection nozzle and includes a compressed air inlet adapted to receive compressed air from a compressor in the gas turbine;

a first fuel-air mixing zone in the distal section of the air tube and downstream of the fuel injection nozzle, a flame holder comprising a porous structure connected to the distal section of the air tube and defining a downstream end of the first fuel-air mixing zone, wherein, prior to and upstream from combustion, fuel and air from the first fuel-air mixing zone pass through the porous structure of the flame holder and into a combustion zone of the combustor and continuous combustion of the fuel and air first occurs in the combustion zone.

2. An air fuel assembly as in claim 1 wherein the porous structure is seated in an outlet of the distal section of the air tube.

3. An air fuel assembly as in claim 1 wherein the porous structure spans an entirety of an outlet of the distal section of the air tube.

4. An air fuel assembly as in claim 1 wherein the porous structure is a honeycomb structure.

5. An air fuel assembly as in claim 1 wherein the porous structure includes air and fuel mixture flow passages, wherein the flow passages are skewed with respect to the center axis.

6. An air fuel assembly as in claim 5 wherein the flow passages impart swirl to the air fuel mixture passing through the flame stabilizer.

7. An air fuel assembly as in claim 1 wherein the porous structure includes a thermal barrier coating on surfaces facing the combustion zone.

8. An air fuel assembly as in claim 1 wherein the porous structure comprises a second fuel-air mixing zone wherein fuel and air mix while passing through the porous structure.

* * * * *